US006540049B1

(12) United States Patent
Ring et al.

(10) Patent No.: US 6,540,049 B1
(45) Date of Patent: Apr. 1, 2003

(54) GRADUAL RELEASE MECHANISM FOR A RAILWAY CAR HAND BRAKE

(75) Inventors: Michael E. Ring, Crown Point, IN (US); David C. Brabb, Chicago, IL (US); Wajih Kanjo, Lockport, IL (US); Alfonso Barajas, Dyer, IN (US)

(73) Assignee: Westinghouse Air Brake Technologies Corporations, Wilmerding, PA (US)

( * ) Notice: Subject to any disclaimer, the term of this patent is extended or adjusted under 35 U.S.C. 154(b) by 0 days.

(21) Appl. No.: 09/642,986

(22) Filed: Aug. 21, 2000

(51) Int. Cl.[7] ..... B61H 13/00

(52) U.S. Cl. ..... 188/33; 188/107; 192/16; 74/505

(58) Field of Search ..... 74/505; 192/15, 192/16, 12 B, 95; 188/47, 33, 107

(56) References Cited

U.S. PATENT DOCUMENTS 3,040,597 A * 6/1962 Bretz ..... 74/505
3,390,590 A * 7/1968 Natschke ..... 74/505
3,425,294 A * 2/1969 Klasing ..... 74/505
3,620,098 A * 11/1971 Natschhke ..... 74/505
3,625,086 A * 12/1971 Natschhke ..... 74/505
3,668,944 A * 6/1972 Natschhke ..... 74/505
3,923,287 A * 12/1975 Weseloh et al. ..... 74/505
3,988,944 A * 11/1976 Klasing ..... 74/505
4,182,197 A * 1/1980 Olander ..... 74/505
4,291,793 A * 9/1981 Klasing ..... 74/505

* cited by examiner

*Primary Examiner*—Jack Lavinder
*Assistant Examiner*—Robert A. Siconolfi
(74) *Attorney, Agent, or Firm*—James Ray & Associates

(57) ABSTRACT

A gradual release mechanism for use in a hand brake device engageable with a railway car. Such gradual release mechanism comprising an operating shaft for rotation about an axis extending longitudinally of the shaft. A clutch flange portion disposed intermediate both ends of shaft, the clutch flange having a clutch surface. A sleeve concentrically disposed and threadedly mounted on the shaft for rotational movement therewith, the sleeve having a clutch surface opposed to the clutch surface of the clutch flange portion of the shaft. An externally threaded surface on the operating shaft engageable with an internally threaded surface on the sleeve, the threads having a pitch between about 0.60 inch and about 1.00 inch. A ratchet wheel received about the shaft, such ratchet wheel having oppositely disposed clutch surfaces positioned for engagement by the clutch collar portions respectively. A pinion journaled on the shaft and adjacent the sleeve.

20 Claims, 3 Drawing Sheets

GRADUAL RELEASE MECHANISM FOR A RAILWAY CAR HAND BRAKE

FIELD OF INVENTION

The present invention relates, in general, to a gradual release mechanism for a railway car hand brake and, more particularly, this invention relates to a hand brake operating shaft assembly with a reduced release torque.

BACKGROUND OF THE INVENTION

Prior to the present invention, when controlled release of a hand brake for a railway car is desired, a hand wheel is moved in a counterclockwise direction. This movement has the effect of turning a threaded operating shaft relative to a threaded sleeve so as to sufficiently free the clutch flange surfaces on the operating shaft and the sleeve from the mating surfaces of the ratchet wheel.

When the counterclockwise movement of the hand wheel ceases, the tension on the brake chain allows the sleeve to return to full clamping relation with the ratchet wheel.

The torque required for overcoming the clamping forces created as a result of friction between the mating threaded surfaces of the operating shaft and the sleeve, and the clutch flange surfaces on the ratchet wheel to release the hand brake is typically at or above the input torque.

An example of this type hand brake is taught in U.S. Pat. No. 3,923,287. The teachings of this reference are incorporated herein by reference thereto.

There are several disadvantages to this current design. For example, the continuous high forces necessary to overcome the frictional forces of the present design will result in premature wear and subsequent replacement of parts. Finally, the potential for failure may exist in service if prematurely worn parts are not detected and replaced in a timely manner.

SUMMARY OF THE INVENTION

In a first aspect, the present invention provides a gradual release mechanism for a hand brake. The mechanism includes an operating shaft for rotation about an axis extending longitudinally of the shaft. A clutch flange portion is disposed intermediate both ends of the operating shaft, with the clutch flange having a clutch surface. A sleeve is concentrically disposed and threadedly mounted on the operating shaft for rotational movement. The sleeve comprises a clutch collar having a clutch surface opposed to the clutch surface of the operating shaft clutch flange portion. An externally threaded surface on the operating shaft is engageable with an internally threaded surface on the sleeve, having a pitch between about 0.60 inch and about 1.00 inch. A ratchet wheel is received about the operating shaft, having oppositely disposed clutch surfaces positioned for engagement by the clutch collar portions of the operating shaft and the sleeve. A pinion is journaled on the operating shaft and is adjacent to the sleeve.

In a further aspect, the present invention provides a gradual release mechanism for a hand brake. The mechanism includes an operating shaft for rotation about an axis extending longitudinally of the shaft. A clutch flange portion is disposed intermediate both ends of the operating shaft, with such clutch flange having a clutch surface. A sleeve is concentrically disposed and threadedly mounted on the operating shaft for rotational movement. The sleeve comprises a clutch collar having a clutch surface opposed to the clutch surface of such operating shaft clutch flange portion. An externally threaded surface on the operating shaft is engageable with an internally threaded surface on the sleeve. A ratchet wheel is received about the operating shaft, having oppositely disposed clutch surfaces positioned for engagement by the clutch collar portions of the operating shaft and the sleeve. A pinion is journaled on the operating shaft and is adjacent to the sleeve. At least one friction plate is engageable at least one of the clutch surfaces of the clutch flange and the clutch collar, respectively, and a clutch surface of the ratchet wheel.

In still a further aspect, the present invention provides a gradual release mechanism for a hand brake. The mechanism includes an operating shaft for rotation about an axis extending longitudinally of the shaft. A clutch flange portion is disposed intermediate both ends of the operating shaft, with clutch flange having a clutch surface. A sleeve is concentrically disposed and threadedly mounted on the operating shaft for rotational movement. The sleeve comprises a clutch collar having a clutch surface opposed to the clutch surface of operating shaft clutch flange portion. An externally threaded surface on the operating shaft is engageable with an internally threaded surface on the sleeve, wherein at least one of the threaded surface of the operating shaft and sleeve is plated. A ratchet wheel is received about the operating shaft, having oppositely disposed clutch surfaces positioned for engagement by the clutch collar portions of the operating shaft and the sleeve. A pinion is journaled on the operating shaft and is adjacent to the sleeve.

OBJECTS OF THE INVENTION

It is therefore a primary object of the present invention to provide a gradual release mechanism with a reduced release torque for a railway car hand brake.

It is a further object of the present invention to increase operator safety and minimize operating costs as a result by reducing the torque required to release the hand brake.

Still a further object of the present invention is to increase component life by reducing frictional forces between mating parts.

Still a further object of the present invention is to prevent premature failure of the hand brake as a result of worn components.

In addition to the various objects of the invention that have been described above, various other objects and advantages will become more readily apparent to those persons skilled in the relevant art from the following more detailed description of the invention, particularly, when such description is taken in conjunction with the attached drawing figures and the appended claims.

Figure 1:
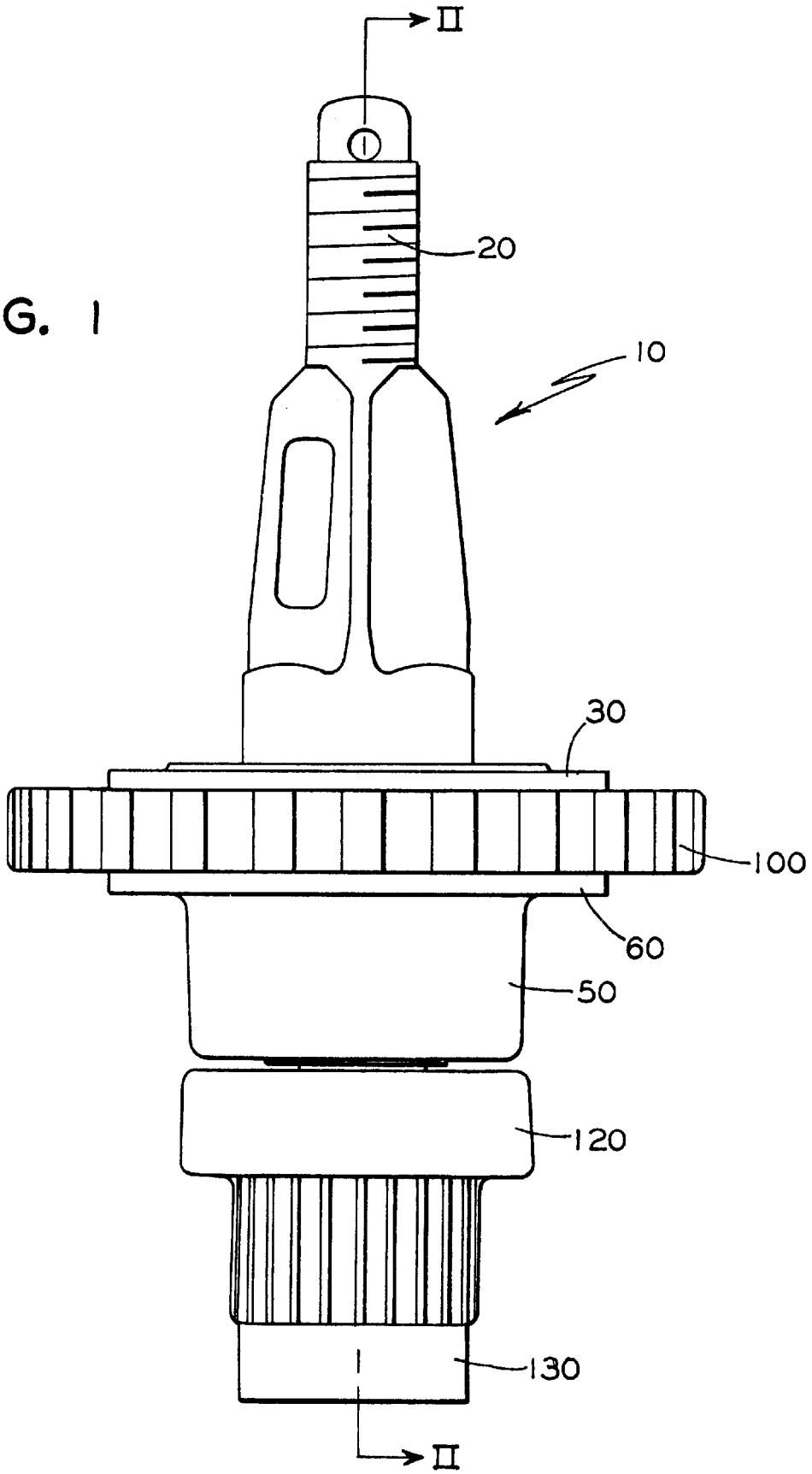
FIG. 1 is a side elevational view of a presently preferred embodiment of a gradual release mechanism for a railway car hand brake.

BRIEF DESCRIPTION OF A PRESENTLY PREFERRED AND VARIOUS ALTERNATIVE EMBODIMENTS OF THE PRESENT INVENTION

Prior to proceeding to a more detailed description of the invention, it should be noted that identical components having identical functions have been designated with identical reference numerals for the sake of clarity.

Figure 2:
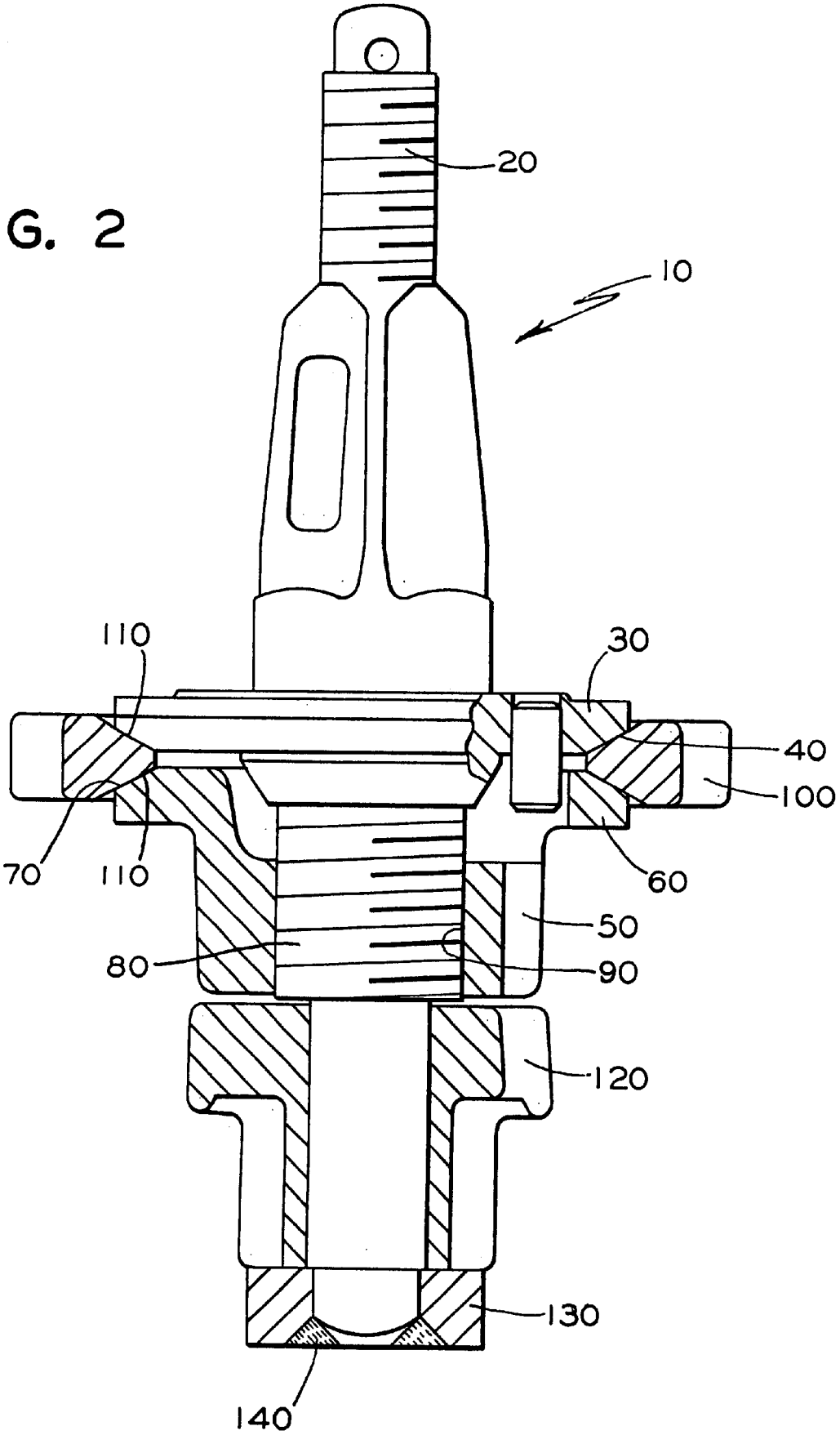
FIG. 2 is a vertical sectional view of the gradual release mechanism taken substantially along line II—II of FIG. 1.
Figure 3:
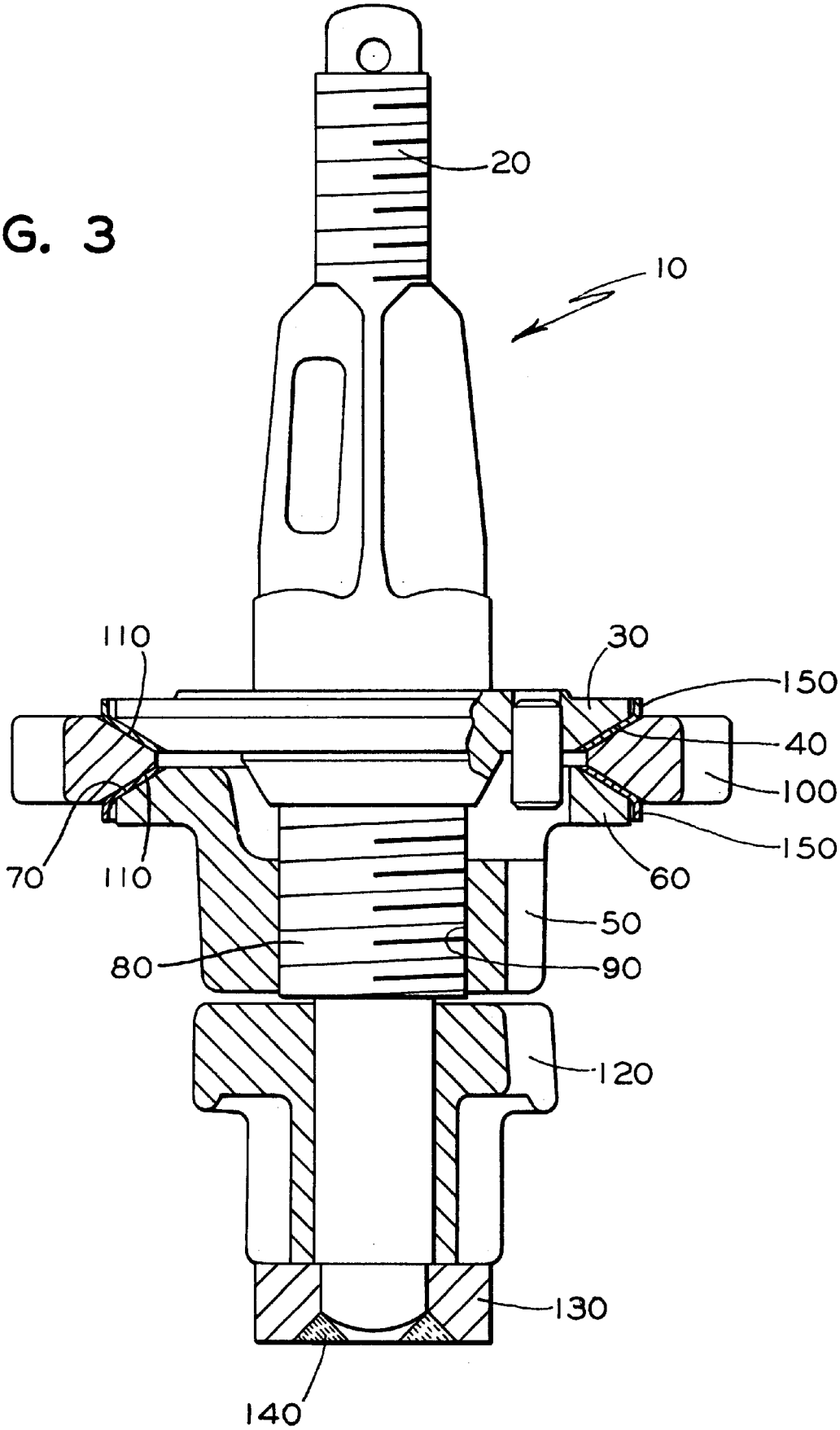
FIG. 3 is a vertical sectional view similar to FIG. 2, illustrating the mechanism with friction plates.

Now refer more particularly to FIGS. 1, 2, and 3 of the drawings. Illustrated therein is a gradual release mechanism, generally designated 10, for a railway car hand brake device, comprising an operating shaft 20, for rotation about an axis extending longitudinally along the shaft. The gradual release mechanism 10 further includes a clutch flange portion 30 disposed intermediate both ends of operating shaft 10, clutch flange portion 30 having a clutch surface 40. A sleeve 50 is concentrically disposed and threadedly mounted on operating shaft 20 for rotational movement therewith. The sleeve 50 includes a clutch collar 60, having a clutch surface 70 opposed to clutch surface 40 of the clutch flange portion 30 of operating shaft 20. An externally threaded surface 80 on operating shaft 20 is engageable with an internally threaded surface 90 on sleeve 50. The threaded surfaces 80 and 90 respectively have a pitch between about 0.60 inch and about 1.00 inch. A ratchet wheel 100 is received about operating shaft 20, having oppositely disposed clutch surfaces 110 positioned for engagement by the clutch collar portions 30 and 60. A pinion 120 is journaled on the operating shaft 20 and adjacent the sleeve 50. The mechanism 10 further includes a bearing 130 journaled on the operating shaft 20 and adjacent the pinion 120. The bearing 130 is secured to an end of operating shaft 20. Preferably, the bearing 130 is secured to an end of the operating shaft 20 by a weld 140.

Further included in the mechanism 10 is at least one friction plate 150. Preferably, the friction plate 150 is metallic. Further included in the mechanism 10 is a plurality of friction plates 150, preferably two. The friction plates 150 are disposed intermediate to the clutch surfaces 40 and 70 respectively of the clutch flange 30 of the operating shaft 20 and the clutch collar 60 of the sleeve 50, and the clutch surfaces 110 of the ratchet wheel 100. (FIG. 3).

Now refer more particularly to FIGS. 1, 2, and 3 of the drawings for a further embodiment of the present invention. Illustrated therein, is a gradual release mechanism, generally designated 10 for a railway car hand brake device comprising an operating shaft 20, for rotation about an axis extending longitudinally along the shaft. The gradual release mechanism 10 further includes a clutch flange portion 30 disposed intermediate both ends of operating shaft 10, clutch flange portion 30 having a clutch surface 40. A sleeve, generally designated 50 is concentrically disposed and threadedly mounted on operating shaft 20 for rotational movement therewith. The sleeve includes a clutch collar 60, having a clutch surface 70 opposed to clutch surface 40 of the clutch flange portion 30 of operating shaft 20. An externally threaded surface 80 on operating shaft 20 is engageable with an internally threaded surface 90 on sleeve 50. A ratchet wheel, generally designated 100 is received about operating shaft 20, having oppositely disposed clutch surfaces 110 positioned for engagement by the clutch collar portions 30 and 60. A pinion 120 is journaled on the operating shaft 20 and adjacent the sleeve 50. At least one friction plate 150 is disposed intermediate one of the clutch surfaces 40 and 70 of the clutch flange 30 and the clutch collar 60.

Further included in the mechanism 10 is a plurality of friction plates 150, preferably two.

The mechanism 10 further includes a bearing 130 journaled on the operating shaft 20 adjacent the pinion 120.

Further included in the mechanism 10 is an externally threaded surface 80 on operating shaft 20 that is engageable with an internally threaded surface 90 on sleeve 50. Preferably, the threaded surfaces 80 and 90 respectively have a pitch between about 0.60 inch and about 1.00 inch. This pitch may be higher, however, a change in the angle of the clutch surfaces may be required.

Now refer more particularly to FIGS. 1, 2, and 3 of the drawings for still a further embodiment of the present invention. Illustrated therein, is a gradual release mechanism, generally designated 10 for a railway car hand brake device comprising an operating shaft 20, for rotation about an axis extending longitudinally along the shaft. The gradual release mechanism 10 further includes a clutch flange portion 30 disposed intermediate both ends of operating shaft 10, clutch flange portion 30 having a clutch surface 40. A sleeve, generally designated 50 is concentrically disposed and threadedly mounted on operating shaft 20 for rotational movement therewith. The sleeve includes a clutch collar 60, having a clutch surface 70 opposed to clutch surface 40 of the clutch flange portion 30 of operating shaft 20. An externally threaded surface 80 on operating shaft 20 is engageable with an internally threaded surface 90 on sleeve 50. At least one of the threaded surfaces 80 and 90 is plated. Preferably, the plating is nickel. A ratchet wheel, generally designated 100 is received about operating shaft 20, having oppositely disposed clutch surfaces 110 positioned for engagement by the clutch collar portions 30 and 60. A pinion 120 is journaled on the operating shaft 20 and adjacent the sleeve 50.

The mechanism 10 further includes at least one friction plate 150. Preferably, the mechanism 10 includes a plurality of friction plate 150, specifically two.

Further included is the externally threaded surface 80 on operating shaft 20 and the internally threaded surface 90 on sleeve 50 having a pitch between about 0.60 inch and about 1.00 inch.

Still further included is a ratchet wheel 100 with a plated surface. Preferably, the plating is nickel.

Although the invention has been shown in connection with a certain specific embodiment, it will be readily apparent to those skilled in the art that various changes in form and arrangement of parts and method may be made to suit requirements without departing from the spirit and scope of the invention.

We claim:

1. A gradual release mechanism for use in a hand brake device engageable with a railway car, said gradual release mechanism comprising:

(a) an operating shaft for rotation about an axis extending longitudinally of said shaft;

(b) a clutch flange portion disposed intermediate both ends of said shaft, said clutch flange having a clutch surface disposed at a first predetermined angle with respect to said axis extending longitudinally of said shaft;

(c) a sleeve concentrically disposed and threadedly mounted on said shaft for rotational movement therewith, said sleeve having a clutch collar, said clutch collar having a clutch surface and radially opposed to said clutch surface of said clutch flange portion of said shaft;

(d) an externally threaded surface on said shaft engageable with an internally threaded surface on said sleeve, said threads having a pitch between about0.60 inch and about 1.25 inch;

(e) a ratchet wheel received about said shaft, said ratchet wheel having oppositely disposed conical clutch surfaces positioned for engagement by said clutch surface carried by said flange and said clutch surface carried by said clutch collar portion respectively; and (f) a pinion journaled on said shaft and adjacent said sleeve.

2. A gradual release mechanism according to claim 1 wherein said mechanism further includes a bearing journaled on said shaft adjacent said pinion.

3. A gradual release mechanism according to claim 2 wherein said bearing is secured to an end of said shaft.

4. A gradual release mechanism according to claim 3 wherein said bearing is secured by a weld.

5. A gradual release mechanism according to claim 1 wherein said mechanism further includes at least one friction plate.

6. A gradual release mechanism according to claim 5 wherein said mechanism further includes a plurality of friction plates.

7. A gradual release mechanism according to claim 6 wherein said plurality is two.

8. A gradual release mechanism according to claim 5 wherein at least one friction plate is engageable with at least one of the clutch surfaces of the clutch flange and the clutch collar, respectively, and a clutch surface of said ratchet wheel.

9. A gradual release mechanism for use in a hand brake device engageable with a railway car, said gradual release mechanism comprising:

(a) an operating shaft for rotation about an axis extending longitudinally of said shaft;

(b) a clutch flange portion disposed intermediate both ends of said shaft, said clutch flange having a clutch surface disposed at a first predetermined angle with respect to said axis extending longitudinally of said shaft;

(c) a sleeve concentrically disposed and threadedly mounted on said shaft for rotational movement therewith, said sleeve having a clutch collar, said clutch collar having a clutch surface and radially opposed to said clutch surface of said clutch flange portion of said shaft;

(d) an externally threaded surface on said shaft engageable with an internally threaded surface on said sleeve;

(e) a ratchet wheel received about said shaft, said ratchet wheel having oppositely disposed conical clutch surfaces positioned for engagement by said clutch surface carried by said flange and said clutch surface carried by said clutch collar portions respectively;

(f) a pinion journaled on said shaft and adjacent said sleeve; and (g) at least one friction plate disposed intermediate one of said clutch surfaces of said clutch flange and said clutch collar, respectively.

10. A gradual release mechanism according to claim 9 wherein said mechanism further includes a plurality of friction plates, where said plurality is two.

11. A gradual release mechanism according to claim 9 wherein said mechanism further includes a bearing journaled on said shaft adjacent said pinion.

12. A gradual release mechanism according to claim 9 wherein said threads of said externally threaded surface on said shaft and internally threaded surface on said sleeve have a pitch between 0.60 inch and about 1.00 inch.

13. A gradual release mechanism for use in a hand brake device engageable with a railway car, said gradual release mechanism comprising:

(a) an operating shaft for rotation about an axis extending longitudinally of said shaft;

(b) a clutch flange portion disposed intermediate both ends of said shaft, said clutch flange having a clutch surface disposed at a first predetermined angle with respect to said axis extending longitudinally of said shaft;

(c) a sleeve concentrically disposed and threadedly mounted on said shaft for rotational movement therewith, said sleeve having a clutch collar, said clutch collar having a clutch surface and radially opposed to said clutch surface of said clutch flange portion of said shaft;

(d) an externally threaded surface on said shaft engageable with an internally threaded surface on said sleeve, wherein at least one of said threaded surface of said shaft and said sleeve is plated;

(e) a ratchet wheel received about said shaft, said ratchet wheel having oppositely disposed conical clutch surfaces positioned for engagement by said clutch surface carried by said flange and said clutch surface carried by said clutch collar portions respectively; and (f) a pinion journaled on said shaft and adjacent said sleeve.

14. A gradual release mechanism according to claim 13 wherein said threaded surface of said operating shaft and said sleeve are plated with nickel.

15. A gradual release mechanism according to claim 13 wherein said mechanism further includes at least one of a friction plate.

16. A gradual release mechanism according to claim 13 wherein said mechanism further includes a plurality of friction plates.

17. A gradual release mechanism according to claim 16 wherein said plurality is two.

18. A gradual release mechanism according to claim 13 wherein said threads of externally threaded surface on said shaft and internally threaded surface on said sleeve have a pitch between about 0.60 inch and about 1.00 inch.

19. A gradual release mechanism according to claim 13 wherein the surface of said ratchet wheel is plated.

20. A gradual release mechanism according to claim 19 wherein said ratchet wheel is plated with nickel.

* * * * *